United States Patent [19]

Andrews

[11] 4,400,924

[45] Aug. 30, 1983

[54] METAL ROOFING SYSTEM

[76] Inventor: Charles F. Andrews, 80 Loree La., Millbrae, Calif. 94030

[21] Appl. No.: 199,326

[22] Filed: Oct. 21, 1980

[51] Int. Cl.[3] ..... E04C 1/34

[52] U.S. Cl. ..... 52/466; 52/460; 52/469

[58] Field of Search ..... 52/466, 461, 460, 469, 52/470, 465, 463, 467, 468

[56] References Cited

U.S. PATENT DOCUMENTS

| | | | |
|---|---|---|---|
| 615,178 | 11/1898 | Hooper | 52/461 |
| 615,449 | 12/1898 | Hagerty | 52/459 |
| 2,234,799 | 3/1941 | Eason | 52/459 |
| 2,356,833 | 8/1944 | Doe | 52/466 |
| 2,408,557 | 10/1946 | Huntington | 52/466 |
| 2,784,814 | 3/1957 | Bright | 52/461 |
| 2,855,871 | 10/1958 | Huntington | 52/466 |
| 2,907,287 | 10/1959 | Trostle . | |
| 3,002,591 | 10/1961 | Hess . | |
| 3,063,201 | 11/1962 | Mylander . | |
| 3,139,961 | 7/1964 | Ferrell . | |
| 3,213,583 | 10/1965 | Winski | 52/469 |
| 3,314,203 | 4/1967 | Hill | 52/461 |
| 3,335,537 | 8/1967 | Mackey | 52/463 |
| 3,341,999 | 9/1967 | Berg | 52/460 |
| 3,376,680 | 4/1968 | Gyekis | 52/463 |
| 3,402,521 | 9/1968 | Tischak | 52/460 |
| 3,448,554 | 6/1969 | Apesteguy | 52/461 |
| 3,495,368 | 2/1970 | Krause | 52/469 |
| 3,594,028 | 7/1971 | Scott | 52/471 |
| 3,603,056 | 9/1971 | Roth | 52/461 |
| 4,001,995 | 1/1977 | Cotter | 52/460 |
| 4,135,342 | 1/1979 | Cotter | 52/461 |
| 4,184,299 | 1/1980 | East | 52/463 |
| 4,193,242 | 3/1980 | Vallee | 52/469 |

FOREIGN PATENT DOCUMENTS

| | | | |
|---|---|---|---|
| 1293934 | 4/1962 | France | 52/466 |
| 332402 | 9/1958 | Switzerland | 52/466 |

*Primary Examiner*—John E. Murtagh
*Assistant Examiner*—Henry E. Raduazo
*Attorney, Agent, or Firm*—Naylor, Neal & Uilkema

[57] ABSTRACT

Roofing strip and clip elements are provided with flange elements which are interengageable by tipping the strip elements first in one direction and then in the opposite direction.

A sealing joint is provided by a first set of interengaged surfaces carried by batten and strip members and a second set of interengaged surfaces carried by strip and clip members.

3 Claims, 3 Drawing Figures

METAL ROOFING SYSTEM

BACKGROUND OF THE INVENTION

The background of this invention is the roofing and siding system art wherein metal pans of any desired length may be roll-formed at the job site, attached to a supporting building by clips, and provided with battens for the weatherproofing of the joints.

SUMMARY OF THE INVENTION

The present invention comprises novel complemental shapings of the flange portions of the pans, clips and battens whereby the pans may be quickly assembled in connected relation to the clips by tipping them sideways to engage the pan flanges beneath clip flanges followed by tipping the pans sideways in the opposite direction to their original positions, and whereby the battens may be thereafter snapped into clampings engagement with the flange portions of adjacent pans.

The principal object of the invention is to provide a pan, clip and batten joint which may be quickly and efficiently assembled by hand without requiring any special jigs or tools.

A further object of the invention is to provide a joint of this type with discontinuous clips and with a high area contact between pans and battens to obtain good weatherproofing.

Other objects and advantages will be apparent from the following description taken with the drawing forming part of this specification.

DESCRIPTION OF THE DRAWING

FIG. 3 is an enlarged view in end elevation showing the configuration of the clip, pan and batten connection joint.

DESCRIPTION OF THE PREFERRED EMBODIMENT

Figure 1:
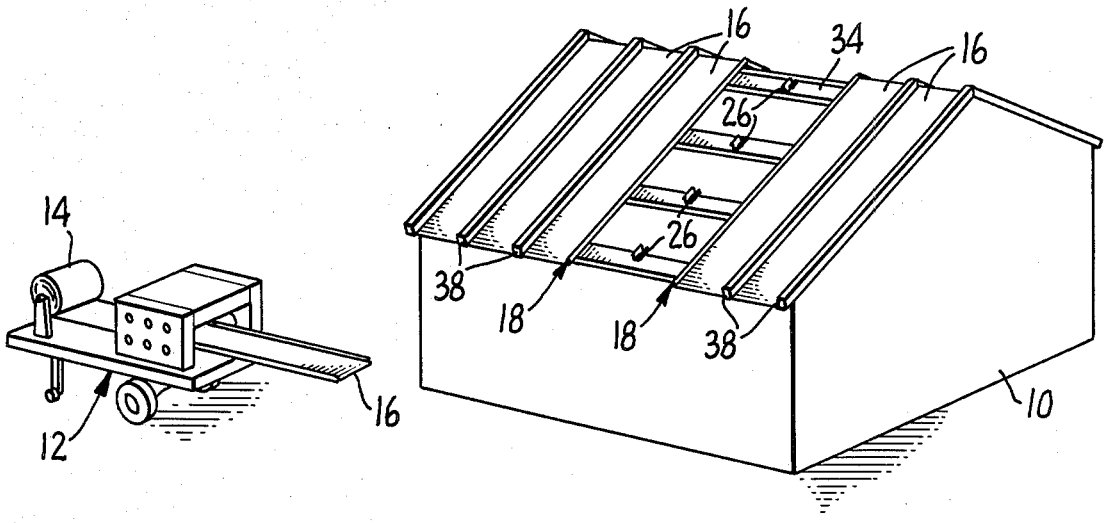
FIG. 1 is a view in perspective of a building and a job site roll former, the former being shown as partially roofed with the subject metal roofing system invention.
Figure 2:
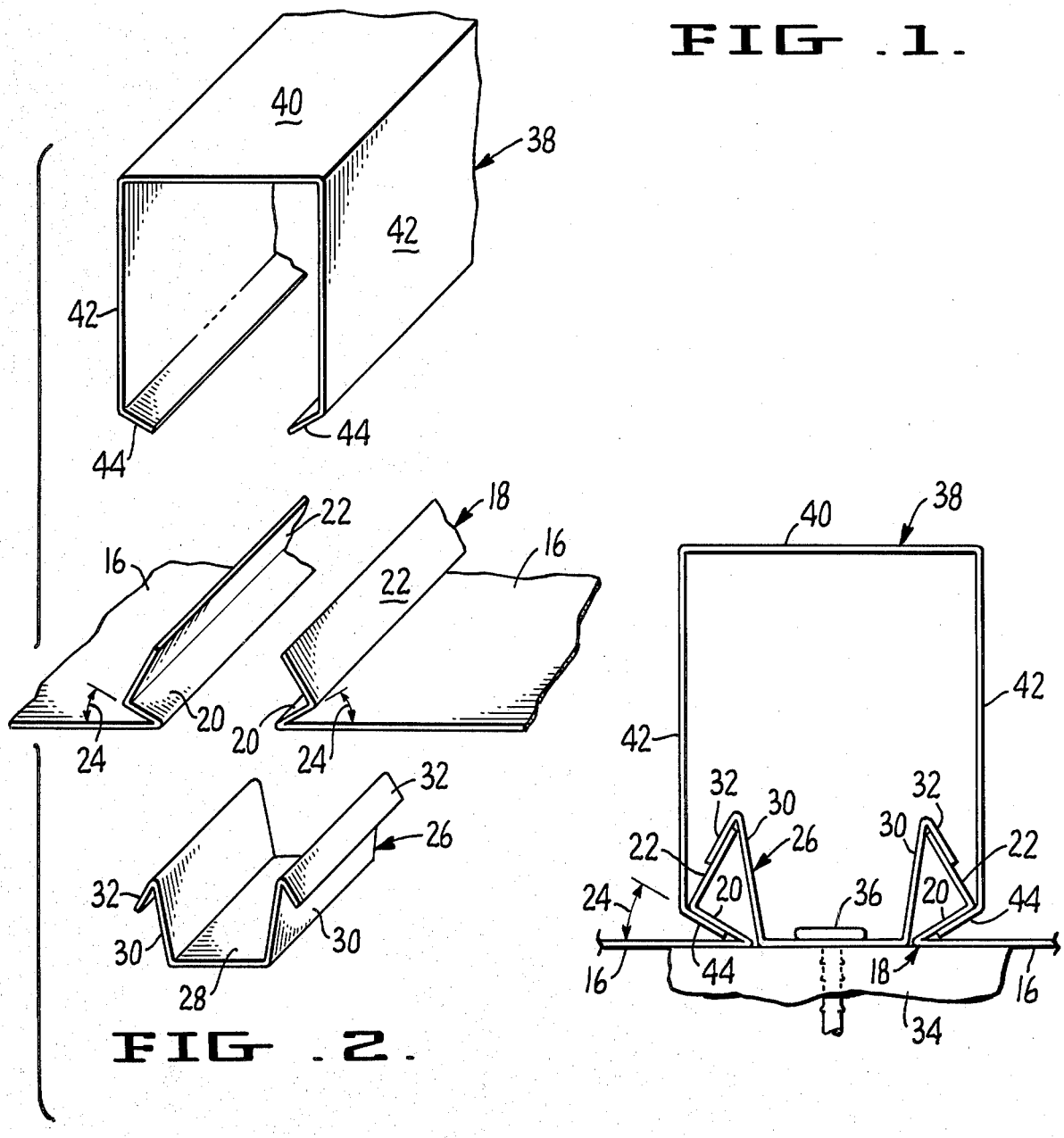
FIG. 2 is an enlarged, exploded view in perspective of the clip, pan and batten elements of the invention.

FIG. 1 shows a building 10 on which a roof according to the present invention is being installed. A roll forming machine 12 is typically used at the job site to convert rolls 14 of strip aluminum into roofing sections 16 of any desired length.

The strips or pans 16 have side flanges 18 comprised of portions 20 and 22. The flange portions 20 are disposed at an acute angle 24 of about 30° to the strip 16. The flange portions 22 are disposed at right angles to flange portions 20.

Adjacent strips 16 are interconnected by clips 26 having central wall portions 28 and side wall portions 30 and 32. The interior angle between 28 and 30 is slightly greater than 90° and the interior angle between

30 and 32 is approximately 40°. The clips 26 are secured to stringers 34 by nails 36.

The strips 16 are attached to the clips 26 by tipping the inner sides of the strips inwardly and downwardly to dispose the flange portions 22 below the side wall portions 32 of clips and by then tipping the strips in the opposite direction to bring portions 22 and 32 into parallel and engaging relation with each other, as shown in FIG. 3.

The clip to strip joint is then enclosed with batten elements 38 comprising central wall portions 40, side wall portions 42 and inwardly inclined portions 44. The battens are pressed downwardly to cause their lower open ends to spread and then to snap-fit around and enclose the clip to strip joint.

The assembled joint of FIG. 3 is substantially weatherproof due to the two sets of interengaged surfaces of wall portion elements 20, 44 and 22, 32. The other important feature and advantage of this roofing and siding system resides in the ease with which the strips 16 may be engaged with clips 26, i.e. by disposing the strips fully in laterally adjacent relation to the clips followed by a tipping of the strips in one direction and then in the other to interengage the flange portions of the strips and clips.

What is claimed is:

1. A roofing joint construction comprising a support member, a clip member attached to said support member, and a pair of strip members attached to said clip member, said clip member comprising a base portion attached to said support member, side walls extending upwardly from said base portion, and lips extending outwardly and downwardly from said side walls at an acute angle with respect thereto, said strip members comprising base portions disposed on said support member, side flanges on said strip member base portions consisting of upwardly and inwardly extending root portions and upwardly and outwardly extending tip portions, said tip portions being disposed in parallel and contactual relation with the underside surfaces of said lips of said clip member, said side flanges of said strip members and said clips being so dimensioned as to make each strip member engageable with an attached clip by tipping said strip member first in one direction, inserting said tip portion of said side flanges in contactual relation with the underside of an attached clip, and then tipping said strip member in the opposite direction.

2. The roofing and siding construction of claim 1, including a batten member overlying and enclosing a joint between said clip member and said pair of strip members, said batten member having side walls terminating at their lower ends in inwardly directed lips, said batten member lips being disposed in parallel and contactual relation with the underside surfaces of said root portions of said strip members.

3. The roofing construction of claim 2, said tip portions of said strip members and said lips of said clip members being in pressing relation with respect to each other, and said lips of said batten member and said root portions of said strip members being in pressing relation with respect to each other.

* * * * *